United States Patent [19]

Georges

[11] Patent Number: 4,592,497

[45] Date of Patent: Jun. 3, 1986

[54] HEATING COAT-HANGER FOR GARMENTS

[76] Inventor: Fournier Georges, 8 rue de l'Aubepine, 42230 Roche la Moliere, France

[21] Appl. No.: 588,896

[22] Filed: Mar. 12, 1984

[30] Foreign Application Priority Data

Mar. 14, 1983 [FR] France ..... 83 04526

[51] Int. Cl.[4] ..... A41H 5/00; A41D 27/22

[52] U.S. Cl. ..... 223/69; 223/85; 223/95

[58] Field of Search ..... 223/69, 73, 85, 88, 223/92, 95, 70, 89; 38/14; 34/243 R, 103–106; D6/315–328, 513, 514; D32/58, 59, 8

[56] References Cited

U.S. PATENT DOCUMENTS

| | | | |
|---|---|---|---|
| 1,268,416 | 6/1918 | Wordingham | 223/88 |
| 2,076,735 | 4/1937 | Leidorf | 34/104 |
| 2,094,042 | 9/1937 | Lichterman | 223/69 |
| 2,410,485 | 11/1946 | Du Nah | 223/70 |
| 2,461,686 | 2/1949 | Hiebert | 223/89 |
| 2,506,513 | 5/1950 | Mayer | 223/69 |
| 2,567,434 | 9/1951 | Haskings | 34/243 R |
| 2,574,999 | 11/1951 | Bell | 223/89 |
| 2,614,337 | 10/1952 | Darbo | 34/104 |
| 3,154,392 | 10/1964 | Littman | 34/104 |
| 3,892,047 | 7/1975 | Müller-Scherak | 34/103 |
| 4,085,519 | 4/1978 | Masika | 34/104 |
| 4,218,608 | 8/1980 | Maroney | 34/243 R |

FOREIGN PATENT DOCUMENTS

| | | | |
|---|---|---|---|
| 1375666 | 9/1964 | France | 223/70 |
| 1540372 | 10/1968 | France . | |
| 597822 | 4/1978 | Switzerland | 223/70 |
| 2095807A | 3/1982 | Switzerland | 34/243 R |
| 821560 | 10/1959 | United Kingdom | 34/243 R |

*Primary Examiner*—Louis K. Rimrodt
*Assistant Examiner*—Joseph S. Machuga
*Attorney, Agent, or Firm*—Remy J. VanOphem

[57] ABSTRACT

A heating coat-hanger for drying damp garments after washing having a pair of lateral branches connected to a central neck. Ducts formed in the central neck and lateral branches, as well as other openings, permit hot air blown into the duct formed in the central neck to be distributed over a suspended garment.

18 Claims, 4 Drawing Figures

HEATING COAT-HANGER FOR GARMENTS

BACKGROUND OF THE INVENTION

The invention relates to a heating coat-hanger for drying damp garments after washing.

It often happens that clothes which are intended to be worn immediately, or to be placed in a suitcase, are still damp. It is then necessary to iron the garment or wear another garment.

Apparatuses for heating garments using electric resistances such as described in French Pat. No. 1,540,372 are known. These apparatuses are not very satisfactory for damp garments because they present safety problems. Furthermore, they offer no support for the garment as it is being dried.

SUMMARY OF THE INVENTION

The object of the present invention is a coat-hanger enabling any kind of garment to be suspended and dried rapidly and efficiently without ironing or the necessity for any incorporated electric heating means.

This result is obtained by utilizing a hollow coat-hanger enabling hot air, provided by an existing appliance such as a hairdryer, to be distributed inside the suspended garment.

The coat-hanger consists of a central portion having an open neck with an internal central duct communicating with lateral ducts formed in the two branches of the coat-hanger. The ducts formed in the branches of the coat-hanger are open at the ends of the branches so as to enable hot air to escape into the sleeves of the suspended garment. Openings are provided in the branches, communicating with the ducts formed in the branches so as to permit the escape of hot air all along the branches, preferably perpendicular to these branches and in a downward direction. The central duct formed in the central neck of the coat-hanger has an opening at the bottom, between the two branches of the coat-hanger. Openings are also provided perpendicular to the central duct formed in the central neck of the coat-hanger. A pivoting shutter placed at the base of the central duct to selectively direct the hot air flowing through the upper part of the central duct is either completely towards the branches or below the coat-hanger.

Fins disposed vertically in the central duct preferentially direct the hot air below the coat-hanger when the shutter is open. These fins also retain the end of the hairdryer.

The central neck is extended below the branches so that the coat-hanger can be attached onto a supporting mount. The supporting mount includes a hollow column, having a central duct pierced with holes, permitting the hot air to escape externally about its periphery.

The upper part of the central duct of the coat-hanger is frustoconical to accomodate various types of hairdryers.

The coat-hanger also includes one or more rods suspended between the ends of the branches so that a pair of pants, for example, can be suspended beneath the bottom opening of the central duct. At least one of the rods ends below the openings in the branches and carries at its ends adapters for holding skirt loops.

A hoop is pivotally attached to the upper part of the central neck. The dimensions of this hoop are sufficient to enable the coat-hanger to be suspended on a rod and provide the space necessary for a hairdryer between the upper part of the central neck and the suspension rod. A jointed hook is attached to the upper part of the hoop. The removal of the jointed hook enables the coat-hanger to be easily carried on the shoulder. The jointed hook, if necessary, may be inserted into a protective bag.

BRIEF DESCRIPTION OF THE DRAWINGS

The attached drawings are given as non-limiting examples of the coat-hanger according to the invention, wherein.

DETAILED DESCRIPTION OF THE PREFERRED EMBODIMENT

Figure 1:
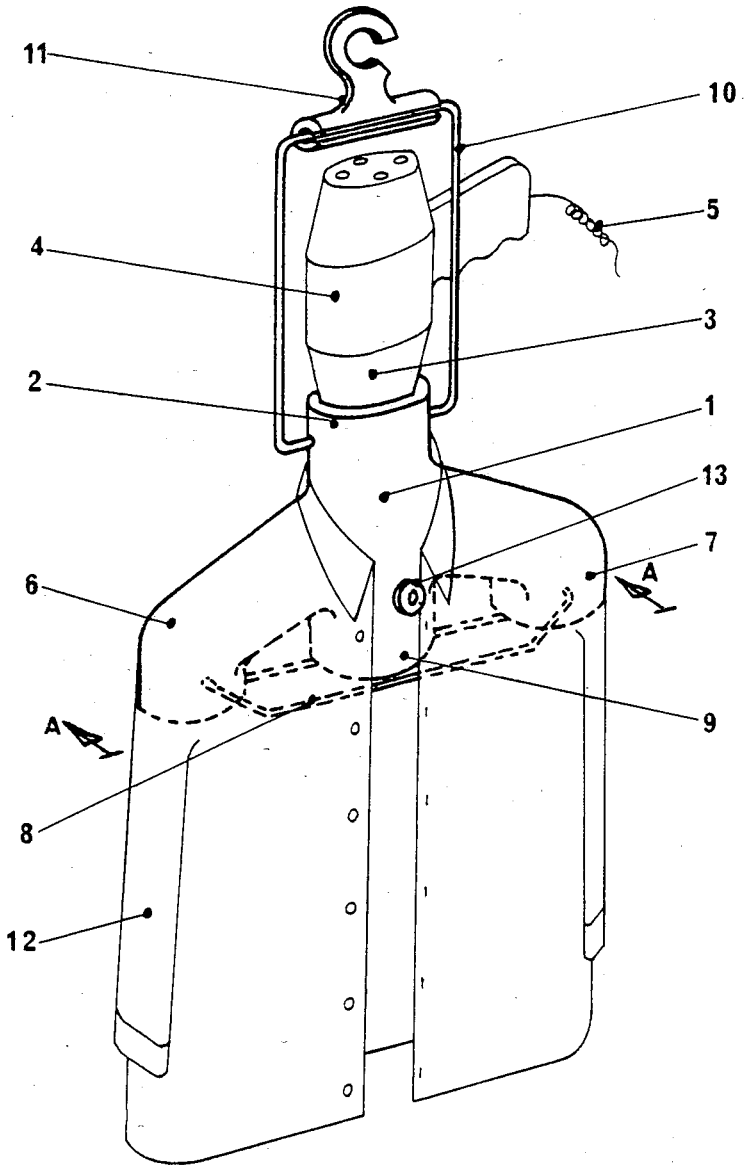
FIG. 1 is an elevational view of the coat-hanger according to the invention, carrying a shirt.

The coat-hanger 1 is shown in FIG. 1. This coat-hanger 1 has a hollow central neck 2 adapted to receive the end 3 of a conventional hairdryer 4. This hairdryer 4 and its electric supply 5 is independent of the coat-hanger 1. The coat-hanger 1 has two lateral branches 6 and 7 connected to the central neck 2.

Figure 2:
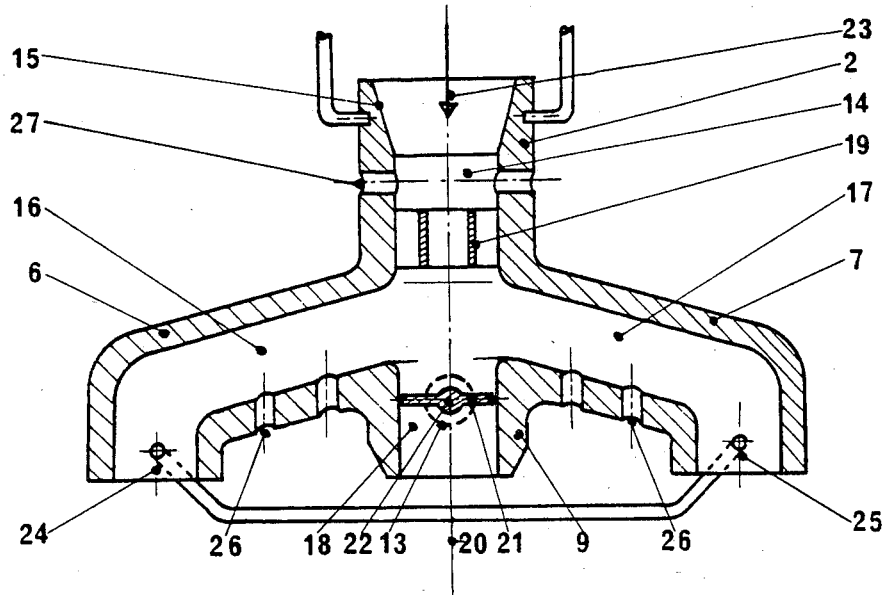
FIG. 2 is a sectional view of the coat-hanger shown in FIG. 1 taken along line A—A, in which the pivoting shutter is shown in the position permitting hot air to flow through the lateral branches.

At least one rod 8 passing under a lower portion 9 of the neck 2 is connected to the ends of the branches 6 and 7. A hoop 10 is pivotally connected to the upper portion of the neck 2. This hoop 10 receives, at its upper part, a hook 11 which is preferably removable. A shirt 12 is shown as an example of a garment. A knob 13 operates a pivoting shutter as shall be described with reference to FIGS. 2 and 3.

The central neck 2 has an internal duct 14, the upper portion 15 of which is flared out so as to conveniently receive a hairdryer 4 as shown in FIG. 1. Internal duct 14 communicates with the ducts 16 and 17 formed in the lateral branches 6 and 7 and the openings 24 and 25 at the ends of these lateral branches. Internal duct 18 is an extension of duct 14 having an opening below the coat-hanger 1.

Within the duct 14 are fins 19 disposed parallel to the axis 20 of the internal ducts 14 and 18.

Within the duct 18 is a pivoting shutter 21 rotatable about a shaft 22 connected to the knob 13 located outside the lower portion 9 of the neck 2.

The ducts 18 and 14 are preferably cylindrical for convenience of manufacture and the pivoting shutter 21 is preferably a disk having a diameter slightly smaller than that of the duct 18.

Figure 4:
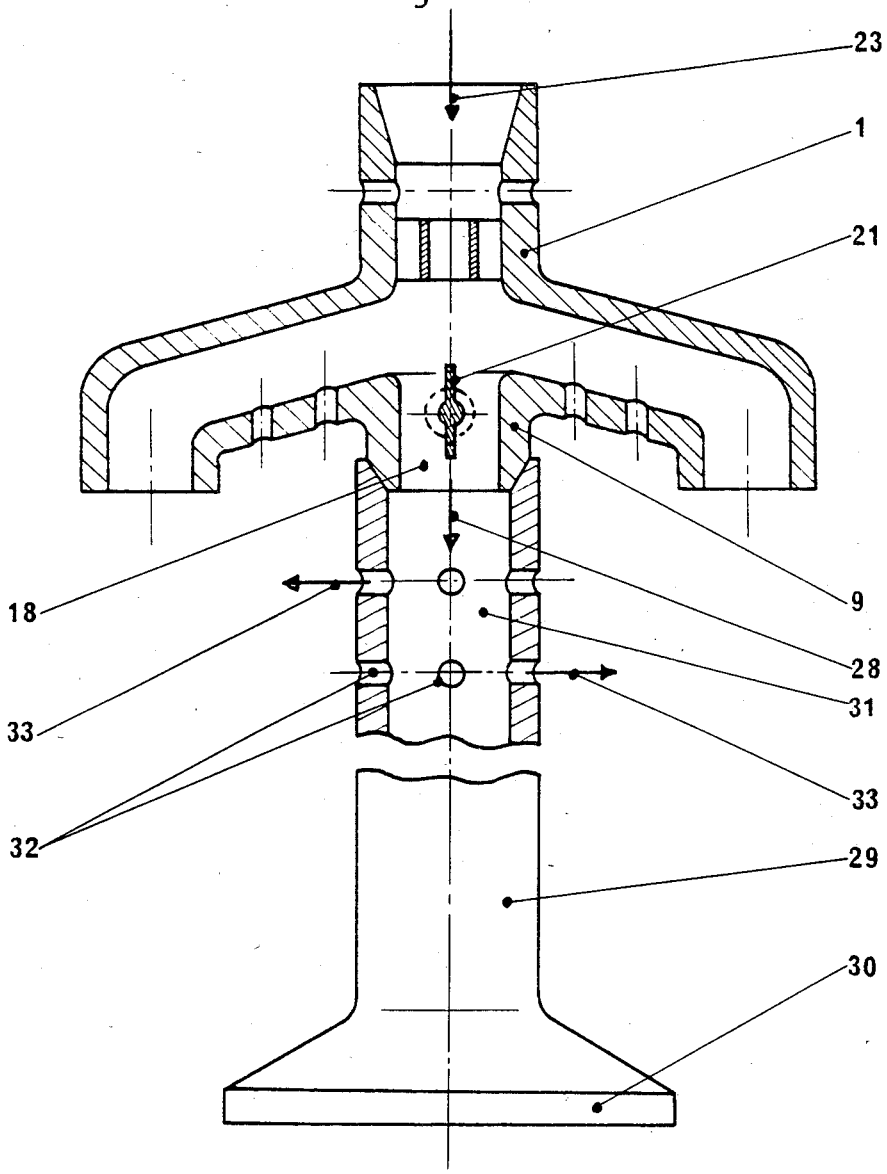
FIG. 4 is a view of the coat-hanger according to the invention, placed on its mount.

The shutter 21 is shown in FIG. 4 in a horizontal position so as to block the duct 18. In this state, hot air blown into the duct 14, as indicated by the arrow 23, will flow through ducts 16 and 17.

In a preferred embodiment of the coat-hanger 1, openings 26 are formed in the lateral branches 6 and 7 between the internal ducts 16 and 17 and the exterior of the lateral branches 6 and 7. In this embodiment, closing of the shutter 21 will cause hot air to likewise leave through openings 26. Openings 27 are also provided perpendicular to the neck 2 to dry shirt collars.

Figure 3:
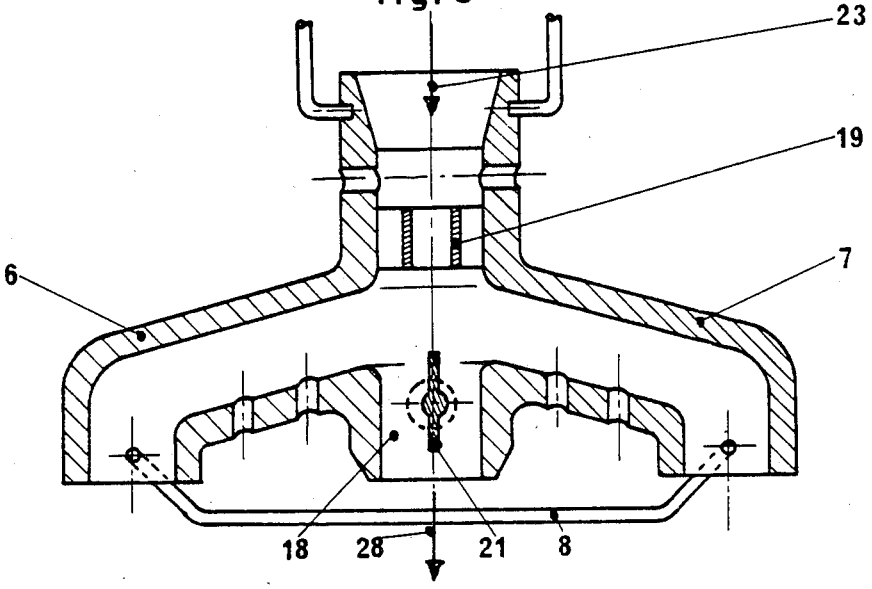
FIG. 3 is a sectional view of the coat-hanger shown in FIG. 1, in which the pivoting shutter is shown in the position permitting hot air to escape through the base of the central neck.

The coat-hanger 1 is shown in FIG. 3, with the shutter 21 positioned vertically so as to permit air flow into the duct 18. It will be understood that in this state, the hot air arriving as indicated by the arrow 23 and guided by the fins 19, preferentially exits through the opening at the bottom of duct 18, indicated by the arrow 28.

It will be understood that if a pair of pants (not shown), for example, is hung on the rod 8 attached to the ends of the branches 6 and 7, it will be rapidly dried by the hot air coming from the duct 18.

The coat-hanger 1 is shown in FIG. 4 in combination with a mount 29. The mount 29 is constituted by a base 30 surmounted by a tube 31, preferably having a cylindrical cross-section. The interior of tube 31 is adapted to receive the lower portion 9 of the neck 2 of the coat-hanger 1, such that the tube 31 becomes an extension of the duct 18. The tube 31 is pierced by several openings 32. It will thus be understood that when the shutter 21 is positioned vertically, the hot air arriving as indicated by the arrow 23, passes as indicated by the arrow 28 into the mount 29, then exits through the openings 32 as indicated by the arrows 33. The hot air is thus distributed over the whole interior of a garment (not shown) hung on the coat-hanger 1 supported by the mount 29.

The advantages of the coat-hanger, according to the present invention, are clearly apparent from the preceding descriptions and Figures.

The coat-hanger, according to the present invention, enables any type of garment to be suspended.

The coat-hanger, according to the present invention, also permits the utilization of a conventional hairdryer, available to everyone, to dry a garment while traveling and, more particularly but not exclusively, to dry shirts.

This drying is carried out on a hanging garment and thus eliminates the need for ironing.

It will be apparent to those skilled in the art that many variations and modifications may be made from the above-described example of structure for the coat-hanger 1. Such variations and modifications are included within the intended scope of the claims appended hereto.

What is claimed is:

1. A coat-hanger for garments for use in combination with an appliance producing a flow of hot air comprising:

a central neck comprising a central duct passing therethrough, said central neck adapted to receive said appliance to produce a hot air flow in said central duct; said central neck further comprising a lower portion having a lower opening for venting said central duct below said coat-hanger; and a pair of lateral branches connected to said central neck above said lower portion of central neck; each of said pair of lateral branches comprising a lateral duct in communication with said central duct and further comprising at least one opening venting said lateral duct external to said pair of lateral branches.

2. The coat-hanger according to claim 1, wherein said at least one opening comprises an opening at a first end of each said pair of lateral branches opposite a second end connected to said central neck.

3. The coat-hanger according to claim 2, wherein said at least one opening comprises a plurality of openings intermediate said first end of said second end of each of said pair of lateral branches.

4. The coat-hanger according to claim 2, and further comprising at least one rod connected between said first end of each of said pair of lateral branches and extending below said lower opening of said central duct.

5. The coat-hanger according to claim 1, wherein said central neck comprises at least one opening provided perpendicular to said central duct for venting said central duct external to said central neck above said lateral branches.

6. The coat-hanger according to claim 5, further comprising a shutter pivotal between an open and closed position, disposed in said lower portion of said central duct.

7. The coat-hanger according to claim 5, further comprising a supporting mount comprising a cylindrical tube vertically supported at one end by a base, said cylindrical tube comprising lateral openings about its periphery, and wherein said lower portion of said central neck is configured to be received in said cylindrical tube at an end opposite said base.

8. The coat-hanger according to claim 1, wherein said central neck extends vertically and comprises fins disposed in said central duct above a zone where said central duct intercepts said lateral duct of each of said pair of lateral branches.

9. The coat-hanger according to claim 1, further comprising a hoop pivotally connected to said central neck.

10. The coat-hanger according to claim 9, and further comprising a hook removably connected to an upper portion of said hoop.

11. A coat-hanger for garments for use in combination with an appliance producing a flow of hot air, said coat-hanger and said appliance being readily separable from one another, said coat-hanger comprising:

a centrally disposed central neck having a central duct passing therethrough, said central neck adapted to receive and support said appliance to produce a hot air flow in said central duct, said central neck further comprising a lower portion having a lower opening for venting said central duct below said coat-hanger; and a pair of lateral branches connected to said central neck above said lower portion of said central neck, each of said pair of lateral branches comprising a lateral duct in communication with said central duct and further comprising at least one opening venting said lateral duct external to each of said pair of lateral branches, said at least one opening being adapted to direct the flow of hot air into a sleeve of a garment suspended on said coat-hanger.

12. The coat-hanger according to claim 11, wherein said central neck comprises at least one opening provided perpendicular to said central duct for venting said central duct external to said central neck above said pair of lateral branches.

13. The coat-hanger according to claim 12, further comprising a shutter pivotal between an open and closed position, disposed in said lower portion of said central duct.

14. The coat-hanger according to claim 12, further comprising a supporting mount comprising a cylindrical tube vertically supported at one end by a base, said cylindrical tube comprising lateral openings about its periphery, and wherein said lower portion of said central neck is configured to be removably received in said cylindrical tube at an end opposite said base.

15. The coat-hanger according to claim 11, wherein said central neck extends vertically and comprises fins disposed in said central duct above the a zone where said central duct intercepts said lateral ducts.

16. The coat-hanger according to claim 11, further comprising a hoop pivotally connected to said central neck.

17. The coat-hanger according to claim 16, further comprising a hook removably connected to an upper portion of said hoop.

18. The coat-hanger according to claim 11, further comprising at least one rod connected between said first end of each of said pair of lateral branches and extending below said lower opening of said central duct.

* * * * *